United States Patent [19]

Utsumi

[11] Patent Number: 4,812,360

[45] Date of Patent: Mar. 14, 1989

[54] THERMAL TRANSFER (PRINTING) MATERIAL

[75] Inventor: Shigeo Utsumi, Yokohama, Japan

[73] Assignee: Diafoil Company, Limited, Tokyo, Japan

[21] Appl. No.: 218,481

[22] Filed: Jul. 7, 1988

Related U.S. Application Data

[63] Continuation of Ser. No. 929,275, Nov. 12, 1986, abandoned.

[30] Foreign Application Priority Data

Nov. 12, 1985 [JP] Japan ..... 60-253413

[51] Int. Cl.[4] ..... B41M 5/20

[52] U.S. Cl. ..... 428/337; 428/195; 428/480; 428/500; 428/910; 428/913; 428/914

[58] Field of Search ..... 428/195, 913, 914, 480, 428/910, 337, 500

[56] References Cited

U.S. PATENT DOCUMENTS 3,937,754 2/1976 Shimotsuma et al. ..... 428/480
4,541,830 9/1985 Hotta et al. ..... 428/409

FOREIGN PATENT DOCUMENTS 60-217194 3/1985 Japan .

*Primary Examiner*—Ellis P. Robinson
*Assistant Examiner*—P. R. Schwartz
*Attorney, Agent, or Firm*—Oblon, Fisher, Spivak, McClelland & Maier

[57] ABSTRACT

Disclosed herein is a thermal transfer (printing) material comprising a base material of a biaxially oriented polyethylene 2,6-naphthalate film of a Young's modulus in the longitudinal direction of not less than 600 kg/mm$^2$ and a thermal transfer layer coated on the film.

2 Claims, No Drawings

THERMAL TRANSFER (PRINTING) MATERIAL

This application is a continuation of application Ser. No. 06/929,275, filed on Nov. 12, 1986, now abandoned.

BACKGROUND OF THE INVENTION

The present invention relates to a thermal transfer (printing) material, and more in detail, the present invention relates to a thermal transfer (printing) material comprising, as a base material, a biaxially oriented polyethylene 2,6-naphthalate film which has a high Young's modulus in the longitudinal direction and heat-resistance, is able to thin the thermal transfer (printing) material and gives clear transcribed letters, and a thermal transfer layer coated on the film.

In recent years, along with the development of office automation, various printing systems have been developed, and of them, a thermal transfer printing system which is small in noise in printing and simple in operation has attracted one's attention.

Ordinarily, a heat-sensitive printing system wherein a thermal head is directly brought into contact to a heat-sensitive printing paper containing a specific colour former has been used. However, although the above-mentioned system is excellent in the operability and maintenance of the thermal printing apparatus, there is a large problem in the long-term preservation of the thus prepared records, because the printing paper is apt to be discolored by heat and light.

Accordingly, a thermal transfer printing system has been spotlighted recently as a system which utilizes the merit of the heat-sensitive printing system and removes the above-mentioned demerit, and has been used broadly.

It is considered that the above-mentioned thermal transfer printing system will be used in future in various printers because of the possibility of printing on ordinary paper sheets, of the excellence in longterm preservation of records and of the excellence in quality of the printed letters. As the printers, for instance, printers for computors, printers for word-processors, video-printers, labelprinters, printers for stillvideocamera, facsimile, etc. may be mentioned. Furthermore, with the remarkable development of computors which easily carry out colorgraphic representation, the improvement of the printer is effected for coloration.

In the thermal transfer printing system, a thermal transfer (printing) material comprising a base material and a thermal transfer layer coated on the base material is used. In case of printing letters, a recording paper sheet (an ordinary paper sheet can be used) is brought into contact to the thermal transfer layer of the thermal transfer (printing) material, a pressure is applied thereon, a thermal head is brought into contact to the opposite side of the base material, a signal current is transmitted to the thermal head in pulse wise to heat the thermal head.

By such a way of transferring a heat-melting ink only from the heated part of the thermal transfer layer or subliming a sublimable ink therefrom, transcription is carried out onto the recording paper. In ordinary cases, the heat-melting ink is easily transferred on the recording paper in the temperature of from 60 to 120° C. of the temperature of the ink, and the sublimable ink sublimes at a temperature of the ink in a range of from 70 to 200° C. and is transcribed.

Generally, the method utilizing the heat-melting ink is called the heat-melting process of thermal transfer printing system, and the method utilizing the sublimable ink is called the subliming process of thermal transfer printing system.

In the cases of the heat-melting process of thermal transfer printing system, a thermal transfer (printing) material having a thermal transfer layer containing carbon black is used in the case of printing all in black color, and for coloration, after preparing separately the three thermal transfer (printing) materials respectively having the thermal transfer layer of one of the three primary colours, namely yellow, magenta and cyan, each colour is thermally transferred once on the same recording paper sheet, three times in total, thereby piling up the three primary colours on the same recording paper sheet.

On the other hand, a characteristic of the subliming process of thermal transfer printing system lies that the harmony of colour tone is easily effected, namely the easy control of the amount of subliming ink is easily effected by the amount of heat of the thermal head.

For making the colour deeper, the applied voltage is raised or the applied time of current pulse is elongated, and on the other hand, for lightening the colour, the applied voltage is lowered or the applied time of current pulse is shortened. By utilizing the above-mentioned system of easily effecting the harmony of colour tone, the subliming process of thermal transfer printing system is applicable in colour print, particularly in colour print of detailed figures and photographs. In the system of colour printing, in the same way as the heat-melting process, the three thermal transfer (printing) materials respectively having one of the three thermal transfer layers of the three primary colours, namely yellow, magenta and cyan are prepared, and the thermal transferring is effected once in one colour, 3 times in total. In the case of using the subliming process of thermal transfer printing system, it is necessary to raise the amount of heat in the thermal head in order to make the colour deeper and accordingly, a higher temperature is applied on the thermal transfer printing material than in the case of using the heat-melting process.

Although in the case of using a subliming ink in the thermal transfer printing system, a special image-receiving layer may be provided on the recording paper sheet, in general, since the recording on an ordinary paper sheet by the thermal transfer printing system is easily carried out, it is possible to remove the demerit of the conventional heat-sensitive recording system. Namely, the thermal transfer printing system is an excellent recording system.

Hitherto, as the base material for the thermal transfer (printing) material, a condenser paper has been used. However, due to the reasons that the condenser paper is low in strength and is easily teared off, and that in the case where it is necessary to thin the base material for obtaining a high speed printing and a clear image, it is difficult to obtain a thinner condenser paper or to reduce the thickness irregularity of the condenser paper, a thin film of polyethylene terephthalate is now used as the base material.

However, at present, for obtaining a further clearer image, a thinner film having a higher heat-resistance is demanded.

However, the polyethylene terephthalate film is insufficient in heat-resistance, and a thin polyethylene terephthalate film having the Young's modulus of not less than 600 kg/cm$^2$ can not be produced. In addition, the polyethylene terephthalate film has a defect of reducing the strength in transverse direction in the case of raising the strength in longitudinal direction.

Accordingly, a development of a film which is more heat-resistant than polyethylene terephthalate film and has a higher strength in longitudinal direction than polyethylene terephthalate film has been demanded. Further, a development of a film which has a higher strength in longitudinal direction than the film of polyethylene terephthalate and at the same time, a high strength in transverse direction has been demanded.

On the other hand, a biaxially oriented polyethylene 2,6-naphthalate film which has the Young's modulus of not less than 510 kg/mm2 (51000 kg/cm$^2$) in longitudinal direction and the Young's modulus of not less than 680,kg/mm (68000 kg/cm$^2$) in transverse direction is useful as the electric insurating material, the supporting material of magnetic recording tape etc. [refer to Japanese Patent Application Laying-Open (KOKAI) No. 50-45877(1975)]; and a magnetic recording tape prepared by forming a magnetic layer on the surface of a biaxially oriented polyethylene 2,6-naphthalate film having the Young's modulus of not less than 510 kg/mm$^2$ in longitudinal direction and the Young's modulus of not less than 680 kg/mm$^2$ in transverse direction [refer to Japanese Patent Publication No. 56-19012(1981)]have been proposed. However, there are no description nor suggestion concerning the use of the polyethylene naphthalate film as the base film for thermal transfer (printing) material.

As a result of the present inventor's studies, it has been found by the present inventor that the abovementioned problems can be solved by using a polyethylene 2,6-naphthalate film of the specified Young's modulus instead of the polyethylene terephthalate film, and on the basis of his finding, the present inventor has attained the present invention.

SUMMARY OF THE INVENTION:

In a first aspect of the present invention, there is provided a thermal transfer (printing) material comprising a biaxially oriented polyethylene 2,6-naphthalate film of Young's modulus in longitudinal direction of not less than 600 kg/mm$^2$ as the base material and a thermal transfer layer coated on the film.

In a second aspect of the present invention, there is provided a film for a thermal transfer (printing) material, comprising a biaxially oriented polyethylene 2,6-naphthalate film of Young's modulus in longitudinal direction of not less than 600 kg/mm$^2$

DETAILED DESCRIPTION OF THE INVENTION

The polyethylene 2,6-naphthalate used in the present invention represents a polymer constructed substantially of the ethylene 2,6-naphthalate as the constitutional unit, and also ethylene 2,6-naphthalate polymers modified with a small amount of e.g. less than 10 mol %, preferably less than 5 mol % of a third component.

Polyethylene 2,6-naphthalate is generally produced by polycondensing naphthalene-2,6-dicarboxylic acid or a functional derivative thereof, for instance, methyl naphthalenedicarboxylate and ethylene glycol in the presence of a catalyst under suitable reaction conditions. As a third component, dicarboxylic acids such as adipic acid, sebasic acid, phthalic acid, isophthalic acid, terephthalic acid, naphthalene-2,7-dicarboxylic acid, etc. and lower alkyl esters thereof; oxycarboxylic acids such as p-oxybenzoic acid and lower alkyl esters thereof; dihydric alcohols such as propylene glycol, trimethylene glycol, tetramethylene glycol, pentamethylene glycol, hexamethylene glycol, diethylene glycol, etc; and polyalkylene glycols such as polyethylene glycol, polytetramethylene glycol, etc. may be exemplified. Further, in the polycondensation, a polycondensation regulator, crystallization regulator, plasticizer, flatting agent, stabilizer may be added.

Since the mechanical properties of the polyethylene naphthalate for use in the present invention is reduced in the case where the polymerization degree is too low, the intrinsic viscosity thereof is preferably not less than 0.40, more preferably in the range of from 0.40 to 0.90. In addition, concerning the density of the polyethylene naphthalate, it is preferably not less than 1.360, more preferably not less than 1.370. In the case of the density of below 1.360, such a polyethylene naphthalate is not preferable because of the high shrinkage ratio of the film prepared therefrom.

For preventing the sticking of the film of the present invention, fine particles of an inert compound may be contained in the film, thereby giving a sliding property to the film. As one of the methods, there is a method wherein, in the production of the polyethylene naphthalate, a phosphorus compound, etc. is reacted with a metallic compound dissolved in the reaction system after esterification or ester interchange reaction, thereby depositing out the fine particles, namely, a particle deposition method.

However, since there is a limit in the amount of the thus deposited particles, another method, so-called "a particle addition method" is preferably used.

In short, in the particle addition method, inert fine particles are added to polyethylene naphthalate at any stages of process from the polyester production to film extrusion. As inert fine particles, at least one kind of metallic compound selected from the group consisting of kaoline, talc, magnesium carbonate, calcium carbonate, barium carbonate, calcium sulfate, barium sulfate, lithium phosphate, calcium phosphate, magnesium phosphate, aluminum oxide, silicon oxide, titanium oxide, lithium fluoride, etc. and salts of terephthalic acid of Ca, Ba, Zn, Mn, etc. may be added, however, they are not limited to the above-mentioned compounds.

The shape and form of the inert compound may be spherical, massive or flaky, and also concerning the hardness, density and colour, there are no particular limitation. The average particle diameter of the inert compound is generally from 0.1 to 10 $\mu$m, preferably from 0.3 to 3 $\mu$m in the equivalent diameter of equal volume sphere. The amount of the inert compound added to the film is from 0.01 to 1% by weight, preferably from 0.02 to 0.8% by weight and more preferably from 0.03 to 0.5% by weight. In addition, for the same purpose, various resins, lubricating agents, etc. may be coated on the surfaces of the polyethylene naphthalene film.

The polyethylene 2,6-naphthalate film as the base material of the thermal transfer (printing) material of the present invention must have Young's modulus in longitudinal direction of not less than 600 kg/mm$^2$, preferably not less than 700 kg/mm$^2$, more preferably not less than 1000 kg/mm$^2$ and still more preferably not less than 1300 kg/mm$^2$. In the film of Young's modulus of less than 600 kg/mm$^2$ in longitudinal direction, particularly in the ribbon-like film, it is difficult to thin the

THERMAL TRANSFER (PRINTING) MATERIAL

This application is a continuation of application Ser. No. 06/929,275, filed on Nov. 12, 1986, now abandoned.

BACKGROUND OF THE INVENTION

The present invention relates to a thermal transfer (printing) material, and more in detail, the present invention relates to a thermal transfer (printing) material comprising, as a base material, a biaxially oriented polyethylene 2,6-naphthalate film which has a high Young's modulus in the longitudinal direction and heat-resistance, is able to thin the thermal transfer (printing) material and gives clear transcribed letters, and a thermal transfer layer coated on the film.

In recent years, along with the development of office automation, various printing systems have been developed, and of them, a thermal transfer printing system which is small in noise in printing and simple in operation has attracted one's attention.

Ordinarily, a heat-sensitive printing system wherein a thermal head is directly brought into contact to a heat-sensitive printing paper containing a specific colour former has been used. However, although the above-mentioned system is excellent in the operability and maintenance of the thermal printing apparatus, there is a large problem in the long-term preservation of the thus prepared records, because the printing paper is apt to be discolored by heat and light.

Accordingly, a thermal transfer printing system has been spotlighted recently as a system which utilizes the merit of the heat-sensitive printing system and removes the above-mentioned demerit, and has been used broadly.

It is considered that the above-mentioned thermal transfer printing system will be used in future in various printers because of the possibility of printing on ordinary paper sheets, of the excellence in longterm preservation of records and of the excellence in quality of the printed letters. As the printers, for instance, printers for computors, printers for word-processors, video-printers, labelprinters, printers for stillvideocamera, facsimile, etc. may be mentioned. Furthermore, with the remarkable development of computors which easily carry out colorgraphic representation, the improvement of the printer is effected for coloration.

In the thermal transfer printing system, a thermal transfer (printing) material comprising a base material and a thermal transfer layer coated on the base material is used. In case of printing letters, a recording paper sheet (an ordinary paper sheet can be used) is brought into contact to the thermal transfer layer of the thermal transfer (printing) material, a pressure is applied thereon, a thermal head is brought into contact to the opposite side of the base material, a signal current is transmitted to the thermal head in pulse wise to heat the thermal head.

By such a way of transferring a heat-melting ink only from the heated part of the thermal transfer layer or subliming a sublimable ink therefrom, transcription is carried out onto the recording paper. In ordinary cases, the heat-melting ink is easily transferred on the recording paper in the temperature of from 60 to 120° C. of the temperature of the ink, and the sublimable ink sublimes at a temperature of the ink in a range of from 70 to 200° C. and is transcribed.

Generally, the method utilizing the heat-melting ink is called the heat-melting process of thermal transfer printing system, and the method utilizing the sublimable ink is called the subliming process of thermal transfer printing system.

In the cases of the heat-melting process of thermal transfer printing system, a thermal transfer (printing) material having a thermal transfer layer containing carbon black is used in the case of printing all in black color, and for coloration, after preparing separately the three thermal transfer (printing) materials respectively having the thermal transfer layer of one of the three primary colours, namely yellow, magenta and cyan, each colour is thermally transferred once on the same recording paper sheet, three times in total, thereby piling up the three primary colours on the same recording paper sheet.

On the other hand, a characteristic of the subliming process of thermal transfer printing system lies that the harmony of colour tone is easily effected, namely the easy control of the amount of subliming ink is easily effected by the amount of heat of the thermal head.

For making the colour deeper, the applied voltage is raised or the applied time of current pulse is elongated, and on the other hand, for lightening the colour, the applied voltage is lowered or the applied time of current pulse is shortened. By utilizing the above-mentioned system of easily effecting the harmony of colour tone, the subliming process of thermal transfer printing system is applicable in colour print, particularly in colour print of detailed figures and photographs. In the system of colour printing, in the same way as the heat-melting process, the three thermal transfer (printing) materials respectively having one of the three thermal transfer layers of the three primary colours, namely yellow, magenta and cyan are prepared, and the thermal transferring is effected once in one colour, 3 times in total. In the case of using the subliming process of thermal transfer printing system, it is necessary to raise the amount of heat in the thermal head in order to make the colour deeper and accordingly, a higher temperature is applied on the thermal transfer printing material than in the case of using the heat-melting process.

Although in the case of using a subliming ink in the thermal transfer printing system, a special image-receiving layer may be provided on the recording paper sheet, in general, since the recording on an ordinary paper sheet by the thermal transfer printing system is easily carried out, it is possible to remove the demerit of the conventional heat-sensitive recording system. Namely, the thermal transfer printing system is an excellent recording system.

Hitherto, as the base material for the thermal transfer (printing) material, a condenser paper has been used. However, due to the reasons that the condenser paper is low in strength and is easily teared off, and that in the case where it is necessary to thin the base material for obtaining a high speed printing and a clear image, it is difficult to obtain a thinner condenser paper or to reduce the thickness irregularity of the condenser paper, a thin film of polyethylene terephthalate is now used as the base material.

However, at present, for obtaining a further clearer image, a thinner film having a higher heat-resistance is demanded.

However, the polyethylene terephthalate film is insufficient in heat-resistance, and a thin polyethylene terephthalate film having the Young's modulus of not less than 600 kg/cm$^2$ can not be produced. In addition, the polyethylene terephthalate film has a defect of reducing the strength in transverse direction in the case of raising the strength in longitudinal direction.

Accordingly, a development of a film which is more heat-resistant than polyethylene terephthalate film and has a higher strength in longitudinal direction than polyethylene terephthalate film has been demanded. Further, a development of a film which has a higher strength in longitudinal direction than the film of polyethylene terephthalate and at the same time, a high strength in transverse direction has been demanded.

On the other hand, a biaxially oriented polyethylene 2,6-naphthalate film which has the Young's modulus of not less than 510 kg/mm2 (51000 kg/cm$^2$) in longitudinal direction and the Young's modulus of not less than 680,kg/mm (68000 kg/cm$^2$) in transverse direction is useful as the electric insurating material, the supporting material of magnetic recording tape etc. [refer to Japanese Patent Application Laying-Open (KOKAI) No. 50-45877(1975)]; and a magnetic recording tape prepared by forming a magnetic layer on the surface of a biaxially oriented polyethylene 2,6-naphthalate film having the Young's modulus of not less than 510 kg/mm$^2$ in longitudinal direction and the Young's modulus of not less than 680 kg/mm$^2$ in transverse direction [refer to Japanese Patent Publication No. 56-19012(1981)]have been proposed. However, there are no description nor suggestion concerning the use of the polyethylene naphthalate film as the base film for thermal transfer (printing) material.

As a result of the present inventor's studies, it has been found by the present inventor that the abovementioned problems can be solved by using a polyethylene 2,6-naphthalate film of the specified Young's modulus instead of the polyethylene terephthalate film, and on the basis of his finding, the present inventor has attained the present invention.

SUMMARY OF THE INVENTION:

In a first aspect of the present invention, there is provided a thermal transfer (printing) material comprising a biaxially oriented polyethylene 2,6-naphthalate film of Young's modulus in longitudinal direction of not less than 600 kg/mm$^2$ as the base material and a thermal transfer layer coated on the film.

In a second aspect of the present invention, there is provided a film for a thermal transfer (printing) material, comprising a biaxially oriented polyethylene 2,6-naphthalate film of Young's modulus in longitudinal direction of not less than 600 kg/mm$^2$

DETAILED DESCRIPTION OF THE INVENTION

The polyethylene 2,6-naphthalate used in the present invention represents a polymer constructed substantially of the ethylene 2,6-naphthalate as the constitutional unit, and also ethylene 2,6-naphthalate polymers modified with a small amount of e.g. less than 10 mol %, preferably less than 5 mol % of a third component.

Polyethylene 2,6-naphthalate is generally produced by polycondensing naphthalene-2,6-dicarboxylic acid or a functional derivative thereof, for instance, methyl naphthalenedicarboxylate and ethylene glycol in the presence of a catalyst under suitable reaction conditions. As a third component, dicarboxylic acids such as adipic acid, sebasic acid, phthalic acid, isophthalic acid, terephthalic acid, naphthalene-2,7-dicarboxylic acid, etc. and lower alkyl esters thereof; oxycarboxylic acids such as p-oxybenzoic acid and lower alkyl esters thereof; dihydric alcohols such as propylene glycol, trimethylene glycol, tetramethylene glycol, pentamethylene glycol, hexamethylene glycol, diethylene glycol, etc; and polyalkylene glycols such as polyethylene glycol, polytetramethylene glycol, etc. may be exemplified. Further, in the polycondensation, a polycondensation regulator, crystallization regulator, plasticizer, flatting agent, stabilizer may be added.

Since the mechanical properties of the polyethylene naphthalate for use in the present invention is reduced in the case where the polymerization degree is too low, the intrinsic viscosity thereof is preferably not less than 0.40, more preferably in the range of from 0.40 to 0.90. In addition, concerning the density of the polyethylene naphthalate, it is preferably not less than 1.360, more preferably not less than 1.370. In the case of the density of below 1.360, such a polyethylene naphthalate is not preferable because of the high shrinkage ratio of the film prepared therefrom.

For preventing the sticking of the film of the present invention, fine particles of an inert compound may be contained in the film, thereby giving a sliding property to the film. As one of the methods, there is a method wherein, in the production of the polyethylene naphthalate, a phosphorus compound, etc. is reacted with a metallic compound dissolved in the reaction system after esterification or ester interchange reaction, thereby depositing out the fine particles, namely, a particle deposition method.

However, since there is a limit in the amount of the thus deposited particles, another method, so-called "a particle addition method" is preferably used.

In short, in the particle addition method, inert fine particles are added to polyethylene naphthalate at any stages of process from the polyester production to film extrusion. As inert fine particles, at least one kind of metallic compound selected from the group consisting of kaoline, talc, magnesium carbonate, calcium carbonate, barium carbonate, calcium sulfate, barium sulfate, lithium phosphate, calcium phosphate, magnesium phosphate, aluminum oxide, silicon oxide, titanium oxide, lithium fluoride, etc. and salts of terephthalic acid of Ca, Ba, Zn, Mn, etc. may be added, however, they are not limited to the above-mentioned compounds.

The shape and form of the inert compound may be spherical, massive or flaky, and also concerning the hardness, density and colour, there are no particular limitation. The average particle diameter of the inert compound is generally from 0.1 to 10 $\mu$m, preferably from 0.3 to 3 $\mu$m in the equivalent diameter of equal volume sphere. The amount of the inert compound added to the film is from 0.01 to 1% by weight, preferably from 0.02 to 0.8% by weight and more preferably from 0.03 to 0.5% by weight. In addition, for the same purpose, various resins, lubricating agents, etc. may be coated on the surfaces of the polyethylene naphthalene film.

The polyethylene 2,6-naphthalate film as the base material of the thermal transfer (printing) material of the present invention must have Young's modulus in longitudinal direction of not less than 600 kg/mm$^2$, preferably not less than 700 kg/mm$^2$, more preferably not less than 1000 kg/mm$^2$ and still more preferably not less than 1300 kg/mm$^2$. In the film of Young's modulus of less than 600 kg/mm$^2$ in longitudinal direction, particularly in the ribbon-like film, it is difficult to thin the film even in comparison to the polyethylene terephthalate film, and in the case of using such a film as the base material of the thermal transfer (printing) material, the printed letters are indistinct. Further, Young's modulus in transverse direction is preferable not less than 600 kg/mm$^2$, more preferably not less than 700 kg/mm$^2$ In the film of Young's modulus of less than 600 kg/mm$^2$ in transverse direction, particularly in the leaf film, it is difficult to make the film nerve and to produce a thinner film, and at the time of using the film as the base material of the thermal transfer (printing) material, there may be cases where the improving effect of the clearness of the printed letters is small.

The thickness of the polyethylene 2,6-naphthalate film as the base material of the present invention is from 0.5 to 6 μm, preferably 0.5 to 3 μm.

As the thermal transfer layer coated on the surface of the polyethylene 2,6-naphthalate film as the base material, a publicly known material can be used.

For example, the thermal transfer layer comprises a binder component, a colouring component, etc. as the main component, and may contain additive components such as a dispersing agent. As the binder component, known waxes such as paraffin wax, carnauba wax, ester wax, etc. and various high polymers of a low melting point may be exemplified.

As the colouring component, carbon black, various organic and inorganic pigments, and various organic and inorganic dyestuffs may be exemplified.

As the method of coating the thermal transfer layer on one of the surfaces of the polyethylene 2,6-naphthalate film of the present invention, for instance, a hot-melt coating method, a solution coating method wherein a coating is carried out in the state of adding a solvent such as photogravure method, reverse method and slitdie method, etc. may be exemplified. The thickness of the heat transcription layer is 0.5 to 9 μm.

The method for producing the film of the present invention will be described concretely as follows, however, the method is not limited to those described.

After drying the pellets of polyethylene 2,6-naphthalate in which fine particles of kaoline, silica, etc. have been contained, the thus dried pellets are melt-extruded at a temperature of from 280 to 320° C. and then the thus extruded sheet is cooled to obtain a substantially amorphous and unoriented sheet. At such a time, it is preferable to adopt the electrostatic cooling method. Then, the thus obtained amorphous and unoriented sheet is at first stretched in longitudinal direction at a temperature of from 130 to 170° C. and at a draw ratio of 1.1 to 3.5 times, preferably 1.1 to 3.0 times. The thus obtained film is then stretched in transverse direction at a temperature of from 130 to 180° C. and at a draw ratio of 2.5 to 4.5 times, and then is subjected to thermal treatment while relaxing from 1 to 30% in transverse direction at a temperature of from 130 to 240° C. The thus obtained biaxially oriented film is further stretched in longitudinal direction at a temperature of from 140 to 200° C. at a draw ratio of 1.1 to 4.0 times. Thereafter, the thus treated film is subject to heatset treatment while stretching in transverse direction at a temperature of from 180 to 260° C. and at a draw ratio of from 1.1 to 4.0 times, and then the thus treated film is wound. By carrying out the above-mentioned steps, a polyethylene 2,6-naphthalate film of remarkably high Young's modulus in longitudinal direction and also in transverse direction as compared to the known polyethylene 2,6-naphthalate film can be produced.

The thermal transfer (printing) material of the present invention is superior in heat-resistance to the thermal transfer (printing) material produced by using a polyethylene terephthalate film, is extremely thin in thickness and gives a remarkably clear transferring printing of the letters without any transcription irregularity, and in addition, the thermal transfer (printing) material of the present invention is excellent in running property.

The present invention will be explained concretely while referring to the following Examples and Comparative Examples, and the measurement of the physical properties of the films in the present specification is carried out by the methods shown below:

(1) Young's modulus:

By using a tensilon (made by TOYO-Baldwin Co., Ltd. UTM-III type), Young's modulus was measured at 25° C. and 50% RH under the following conditions.

Shape of a specimen: a long strip type of 15cm in length and 1 cm in width

Interval of chacks : 10 cm

Drawing speed 100 %/min (2) Evaluation of the thermal transfer (printing) material:

On one of the surfaces of a specimen(film), a fluorocarbons polymer is coated as a sticking-preventing layer and a known thermal transfer layer comprising waxs and carbon black is provided on the other surface of the specimen, and the evaluation is carried out by using a typewriter (made by Brother Ind. Co., Ltd., of a type of EP-20) in the form of the ribbon-like specimen.

EXAMPLES 1 and 2

A polyethylene 2,6-naphthalate of an intrinsic viscosity of 0.65 containing 0.08 part by weight of amorphous silica of an average diameter of 1.7 μm was melt-extruded at 295° C. as a raw material, thereby preparing an unstretched film. After stretching the thus obtained film 2.5 times in longitudinal direction at 140° C. and further stretching 4.2 times in transverse direction at 135° C., the thus biaxially stretched film was subjected to heatset treatment at 210° C. while relaxing it 10%.

The thus obtained film was further stretched 1.5 times in longitudinal direction at 150° C. (Example 1) and 2.5 times in longitudinal direction at 150° C. (Example 2).

After still further stretching the thus obtained film 1.1 times in transverse direction while subjecting it to heatset treatment at 230° C., the wound film of 4 micrometers (Example 1) and 2 micrometers (Example 2) in thickness was obtained, respectively.

On the upper surface of the thus obtained film, the following composition was coated as a thermal transfer layer by the hot-melt coating method so that the thickness of the layer became 3 μm, thereby obtaining the thermal transfer (printing) material according to the present invention.

Composition 30 parts by weight of carnauba wax
35 parts by weight of ester wax
12 parts by weight of carbon black
10 parts by weight of polytetrahydrofuran and
3 parts by weight of silicone oil.

COMPARATIVE EXAMPLE 1

By subjecting a polyethylene terephthalate film of an intrinsic viscosity of 0.62 containing 0.08 part by weight of amorphous silica of an average diameter of 1.7 μm to biaxial stretching and heatet treatment while following an ordinary method, a polyethylene terephthalate film of 9 μm in thickness was prepared.

In the same manner as in Example 1, a thermal transfer (printing) material was prepared from the thus obtained polyethylene terephthalate film.

COMPARATIVE EXAMPLE 2

By subjecting a polyethylene terephthalate film of an intrinsic viscosity of 0.62 containing 0.08 part by weight of amorphous silica of an average diameter of 1.7 μm to uniaxially stretching and heatset treatment while following an ordinary method, a polyethylene terephthalate film of 4 μm in thickness was prepared.

In the same manner as in Example 1, a thermal transfer (printing) material was prepared from the thus obtained polyethylene terephthalate film.

The thickness and Young's modulus of each film of Examples 1 and 2 and Comparative Examples 1 and 2, and the results of evaluation of the thermal transfer (printing) materials prepared in Examples 1 and 2 and Comparative Examples 1 and 2 are shown in Table 1.

TABLE 1

| | | Example | | Comparative Example | |
|---|---|---|---|---|---|
| | | 1 | 2 | 1 | 2 |
| Thickness of film (μm) | | 4 | 2 | 9 | 4 |
| Young's Modulus ($kg/mm^2$) | longitudinal | 700 | 1350 | 480 | 620 |
| | transverse | 720 | 650 | 500 | 430 |
| Evaluation as material for transcription | printed letters | clear | clear | indistinct | clear |
| | running property | good | good | good | STICK phenomenon |

What is claimed is:

1. A thermal transfer printing material comprising a film consisting of a biaxially oriented polyethylene 2,6-naphthalate film of Young's modulus in longitudinal direction of not less than 700 $kg/mm^2$ and Young's modulus in transverse direction of not less than 600 $kg/mm^2$ as the base material, and a thermal transfer layer coated on one of the surfaces of said film.

2. A thermal transfer printing material according to claim 1, wherein the thickness of said biaxially oriented polyethylene 2,6-naphthalate film is 0.5 6 μm.

* * * * *